United States Patent [19]

Waite

[11] 4,452,610

[45] Jun. 5, 1984

[54] MODIFIED LIQUID HYDROCARBONS

[75] Inventor: Frederick A. Waite, Farnham Common, England

[73] Assignee: Imperial Chemical Industries PLC, London, England

[21] Appl. No.: 403,818

[22] Filed: Jul. 30, 1982

[30] Foreign Application Priority Data

Aug. 7, 1981 [GB] United Kingdom ..... 8124151

[51] Int. Cl.[3] ..... C10L 1/22

[52] U.S. Cl. ..... 44/62; 44/70

[58] Field of Search ..... 44/62, 70; 526/317, 526/208

[56] References Cited

U.S. PATENT DOCUMENTS

| | | | |
|---|---|---|---|
| 3,803,034 | 4/1974 | Gaydasch | 44/62 |
| 3,812,034 | 5/1974 | Gaydasch | 44/62 |
| 3,846,090 | 11/1974 | Osmond et al. | 44/62 |
| 3,846,091 | 11/1974 | Osmond et al. | 44/62 |
| 3,925,032 | 12/1975 | Osmond et al. | 44/62 |
| 3,998,605 | 12/1976 | Osmond et al. | 44/62 |
| 4,002,436 | 1/1977 | Osmond et al. | 44/62 |
| 4,292,045 | 9/1981 | Brooks et al. | 44/62 |
| 4,334,891 | 6/1982 | Brooks et al. | 44/62 |
| 4,356,003 | 10/1982 | Brooks et al. | 44/62 |

*Primary Examiner*—Charles F. Warren
*Assistant Examiner*—Y. Harris-Smith
*Attorney, Agent, or Firm*—Cushman, Darby & Cushman

[57] ABSTRACT

Modified liquid hydrocarbon fuel, in particular aviation kerosene, having a reduced tendency to undergo mist formation when subjected to shock, contains from 0.05% to 2% of its weight of polymer microgel particles of defined characteristics, the microgel polymer preferably being an addition copolymer of one or more main monomers with a minor proportion, e.g. 0.0005% to 0.1% of the total monomers, of one or more monomers which are multifunctional with respect to the polymerization reaction.

11 Claims, No Drawings

MODIFIED LIQUID HYDROCARBONS

This invention relates to the use of certain polymeric materials as additives to liquid hydrocarbon fuels, in particular aviation kerosene, for the purpose of reducing the tendency of such fuels to form inflammable mists when subjected to shock.

It is known that when a liquid with a free surface is subjected to conditions of shock there is a tendency for the liquid to become disseminated in particulate form and that the effect of shock may be such as to convert a proportion of the liquid into a dispersion of fine liquid droplets in air, i.e. a mist.

It is very desirable to be able to control the extent to which such a dispersion or mist of liquid is formed under shock conditions since, for example, this mist, if inflammable, may constitute a hazard. A situation in which it is most important to keep to a minimum the formation of such mist under shock conditions is the crash of an aircraft carrying inflammable liquids, such as its fuel. Though hydrocarbon fuels now used for aircraft gas tubine engines may be of a higher flash point than aviation gasoline as used in spark ignition engines, with a consequent reduction in the risk of fire due to ignition of vapour, nevertheless mists of fuels with flash points of 50° F. and higher are highly susceptible to ignition by flames, electrical sparking or the effect of friction, as well as by the presence of hot metal in the engines. There is therefore a considerable fire hazard immediately after a crash of an aircraft using such fuel. Furthermore, there is a risk of propagation of fire to the bulk of liquid fuel even if little damage is caused by ignition of the mist itself.

We have found that the tendency to particulate dissemination under shock conditions of a liquid hydrocarbon fuel suitable for use in gas turbine aircraft and having a flash point of at least 50° F. may be reduced by the presence in the liquid fuel of polymer microgel particles of defined characteristics. By "polymer microgel particles" we mean particles of polymer which is at least partially crosslinked.

According to the present invention there is provided a modified liquid hydrocarbon fuel having a flash point of at least 50° F. and having a reduced tendency to particulate dissemination under shock conditions, the fuel containing from 0.05% to 2% of its weight of particles of a polymer microgel having the following characteristics;

(i) The polymer of which the microgel particles are composed would be soluble in the liquid fuel at concentrations in the foregoing range, if the polymer were not crosslinked;

(ii) the degree of crosslinking of the polymer is such that the particles are swollen in the presence of the fuel to an extent such that there is no tendency for the particles to settle so as to form a macroscopic separate phase;

(iii) in the unswollen state, the microgel particles have a size in the range 0.02–0.5 micron.

In referring above to the requirement for solubility in the fuel of the polymer in the uncrosslinked state, we mean that solutions of the uncrosslinked polymer in the fuel, at all concentrations in the range 0.05% to 2% by weight, are, notwithstanding that they may appear hazy or opalescent, nevertheless homogeneous in the sense that no gross separation from them of a swollen polymer phase occurs on standing at 20° C.

Liquid hydrocarbon fuels which are of particular interest for modification according to the invention are those having a flash point above 90° F. and include AVTUR 50 aviation kerosene as defined in U.K. Government Specification D.Eng. RD 2494 (NATO Code No. F-35) with a flash point not lower than 100° F., and aviation turbine fuels JP-8 (flash point 110° F. min.) as specified in U.S. Military Specification MIL-T-83133, JP-5 (flash point 140° F. min.) as specified in U.S. Military Specification MIL-T-5624G, and Jet A and Jet A-1 (flash point 110° F. min.) as specified in ASTM Specification D.1655/68.

Particularly suitable polymers, of which the microgel particles may be composed, are those obtained by addition polymerisation, in particular those derived from one or more main monoethylenically unsaturated monomers which, when homopolymerised or copolymerised, yield products which are soluble in the liquid fuel in the sense defined above, but which are copolymerised with minor proportions of one or more monomers which are multi-functional with respect to the polymerisation reaction and hence give rise to crosslinking of the polymer. Suitable main monomers include the higher alkyl acrylates and methacrylates, in which the alkyl group contains from 4 to 18 carbon atoms, for example 2-ethylhexyl acrylate and dodecyl methacrylate, the higher alkyl styrenes in which the alkyl group contains from 4 to 12 carbon atoms, for example tert-butyl styrene, and vinyl esters of fatty acids, such as vinyl stearate. All of these monomers, individually or in combination, give rise to homopolymers or copolymers (as the case may be) which are soluble in the aviation fuels referred to above in the concentrations called for by the invention. Suitable multifunctional monomers include, for example, isopropenylstyrene, divinylbenzene, ethyleneglycol dimethacrylate, trimethylolpropane triacrylate and allyl methacrylate. The proportion of multifunctional monomer to total monomer should be in the range 0.0001% to 1% by weight, preferably in the range 0.0005% to 0.1% by weight, but the precise proportion to be used in any individual case will be determined by the swelling ratio which it is desired that that the microgel should exhibit in the liquid fuel. In addition to the main monomer and difunctional monomer, the monomers from which the microgel polymer is derived may include minor proportions (generally less than 30% by weight of the total) of other monoethylenically unsaturated monomers which yield polymers that are insoluble in the liquid fuel, such as methyl methacrylate, ethyl acrylate, styrene, vinyl toluene and vinyl acetate.

It is an essential feature of the invention that the microgel polymer carries groups which are capable of associating with one another, for example through hydrogen bond formation in the case of hydroxyl, carboxyl or carboxylamide groups. Such groups are conveniently introduced into the polymer through the medium of yet further constituent monomers which carry one or more of the groups in question. Examples of suitable associative monomers include hydroxyalkyl acrylates and methacrylates, such as hydroxyethyl acrylate and hydroxypropyl methacrylate, acrylic acid, methacrylic acid and their metal or amine salts, acrylamide and methacrylamide. When such monomers are present, their proportion is preferably from 0.5% to 15% by weight of the total monomers.

The degree of swelling which the microgel polymer is required to exhibit in the liquid fuel is determined, as already stated, by the practical consideration that the swollen particles should be incapable of settling out of suspension in the fuel to form an identifiable separate phase or layer. The degree of swelling may be expressed in terms of swelling ratio, i.e. the ratio of the volume of the particle when in equilibrium with the liquid fuel to that of the same particles per se, and in general the swelling ratios for suitable polymers will lie in the range 10–100 at normal ambient temperature. However, the precise measurement of swelling ratio is difficult in practice and we do not regard the invention as being limited by strict reference to this range of values.

Illustration of particular microgel copolymers which are useful in the invention include those derived from (i) a mixture of tert-butylstyrene, methyl methacrylate and methacrylic acid in the weight ratios 83:10:7, containing 0.001% by weight of divinylbenzene; (ii) a mixture of the same main monomers in the same ratios as in (i), containing 0.0025% by weight of divinylbenzene; (iii) a mixture of the same main monomers in the same ratios as in (i), containing 0.01% by weight of ispropenylstyrene; (iv) a mixture of tert-butylstyrene and acrylic acid in the weight ratio 95:5, containing 0.005% by weight of isopropenylstyrene; and (v) a mixture of tert-butylstyrene and methacrylic acid in the weight ratio 93:7, containing 0.005% by weight of isopropenylstyrene.

The microgel polymers can conveniently be obtained by aqueous emulsion copolymerisation of the constituent monomers under certain defined conditions, employing if necessary a minor proportion of a watermiscible organic co-solvent, such as acetone, in order to enhance the solubility of the monomer mixture in the aqueous continuous phase (the main monomers described above will inherently tend to have very low solubilities in water and a measurable degree of solubility in the continuous phase is necessary if the polymerisation is to proceed at an acceptable rate). The polymerisation is carried out at a temperature in the range 0°–60° C., preferably 10°–40° C., in an inert gas atmosphere and in the presence of a water-soluble redox free radical initiator system, such as ammonium persulphate or potassium persulphate in combination with sodium dithionite, sodium sulphite, sodium thiosulphate or ascorbic acid respectively. There may be added to the polymerisation mixture water-soluble surfactants such as sodium dodecylbenzenesulphonate, sodium dioctylsulphosuccinate, sodium lauryl sulphate or salts of sulphated nonylphenol-ethylene oxide condensates. The amount of initiator (or initiator combination) used may typically lie in the range 0.05% to 1%, and the amount of surfactant in the range 1% to 15%, based on the weight of the monomer mixture. The polymerisation may be effected by a "one-shot" procedure, in which all the monomer required is introduced into the reaction mixture at once, or by a "seed and feed" procedure in which a small; proportion of the total monomer mixture is polymerised initially to form a "seed" polymer dispersion and the remainder of the monomer is then added gradually. Chain transfer agents, such as n-octyl mercaptan, dodecyl mercaptan or chlorofrom, may also be added during the course of the polymerisation, especially in the later stages when more than 75% of the monomer has been polymerised, in order to regulate the formation of the polymer. The polymerisation may also be terminated at any desired level of monomer-to-polymer conversion, especially at conversions higher than 75%, through the use of free radical polymerisation inhibitors such as p-benzoquinone. Termination in this way may provide better control of the polymerisation end point, reduce the danger of post-polymerisation of residual monomers during the polymer isolation processes and in many instances obviate the use of chain transfer agents.

The microgel particles obtained in the foregoing manner may be isolated from the aqueous dispersion in ways which are well known in the polymer art. A particularly suitable method is that of spray-drying, in the case of polymers having a glass transition temperature greater than 40° C. The particles may then be introduced into the liquid hydrocarbon fuel by simple addition followed by stirring or agitation, although it may assist the attainment of equilibrium between the particles and the liquid if the latter is at the same time; heated, e.g. to a temperature of about 80° C. Alternatively, the microgel can be introduced into the fuel by adding the aqueous dispersion directly to the fuel maintained at a temperature in the range 103°–150° C., under which conditions the water is removed as an azeotrope with some of the hydrocarbon. As a further alternative, the microgel particles can be blended with a carrier fluid which is essentially a non-swellant for the particles but is miscible with the liquid fuel and is capable of assisting the incorporation of the microgel into the fuel and its equilibration therewith. Suitable carrier fluids are hydroxylic liquids, such as methanol, ethanol, 2-ethoxyethanol, propylene glycol, butylene glycol and 2-methyl-2:4-pentanediol. The mist-suppressing properties of a fuel in which a microgel has been incorporated in this way may be enhanced by the further addition to the fuel of an amine, such as ethylamine, butylamine or diethanolamine; the amine may thus form part of the total carrier fluid.

The modified liquid hydrocarbon fuels thus obtained exhibit a substantially reduced tendency towards mist formation when subjected to shock conditions, as compared with the corresponding unmodified fuels. The effectiveness of this modification can be estimated in the laboratory by determination of the "differential orifice flow rate" of the modified fuel. By this expression we mean the difference between (a) the flow rate of liquid fuel containing the microgel particles through a passage of circular cross-section having a square-edged orifice, the passage having a length of 0.062 inches and a diameter of 0.025 inches, and (b) the flow rate through the same said passage of a Newtonian liquid having the same viscosity as that of the modified liquid fuel referred to in (a) when the said viscosities are measured by the method of British Standards No. 188:1937, the flow rates being expressed as the volume of liquid in ccs. which passes through the orifice during the second period of 30 seconds of flow. Apparatus suitable for carrying out the differential orifice flow rate determination may be constructed by appropriately modifying a type A cup according to British Standards No. 1733. Modified liquid fuel which shows a differential orofice flow rate in the range 3 to 6 ccs. per 30 seconds will in general exhibit satisfactory mist-suppressing properties. The minimum concentration of microgel particles, within the range 0.05% to 2% previously defined, which is required to achieve this performance can readily be found by experiment.

Another test of the effectiveness of the modified fuel according to the invention, and one more closely simulating the conditions to which the fuel would be subjected in an aircraft crash, utilises an apparatus consisting of a small trolley guided along a track and fitted with a propulsion unit capable of accelerating the trolley to a speed of approximately 120 ft/sec. The trolley is coupled to a braking system which is capable of stopping the trolley at a mean deceleration of 30 times the acceleration of gravity. A fuel is attached to the trolley and at the forward end of the fuel tank is an orifice which is closed with a weighted rubber bung. Approximately 45 mls of the fuel to be tested are placed in the tank and the trolley is winched back to a release point from which it is released and accelerated up to a speed of 120 ft/sec. The acceleration takes place along about 10 feet of the track and the trolley is then decelerated along about 10 feet of the track by the braking system so that the weighted bung is ejected and the fuel is expelled through the tank orifice.

There is an ignition array of small gas flames spaced linearly at one foot intervals beneath the portion of the track over which deceleration takes place and beyond the track.

When unmodified aviation fuel is subjected to the test, it produces a flare above the ignition array of 6–7 feet in length and of large volume. On the other hand, when modified aviation fuel according to the invention is subjected to the same conditions, concentrations of microgel of 0.05% or above are found to be effective in preventing any substantial ignition of the fuel. Again, the minimum concentration of any given microgel required to give a satisfactory level of anti-misting performance can be found by experiment.

The invention is illustrated but not limited by the following Examples, in which parts are by weight.

EXAMPLE 1

To a polymerisation vessel fitted with nitrogen inlet extending below the liquid level there was charged the following:

Distilled water: 1152 parts
Acetone: 288 parts
Sodium dioctylsulphosuccinate: 9 parts This charge was stirred until the surfactant had completely dissolved. There was then added the following pre-mixed charge of monomer:

Tert-butylstyrene containing 5 ppm of added divinyl benzene: 298.8 parts
Methyl methacrylate: 36.0 parts
Methacrylic acid: 25.2 parts The temperature of the reaction mixture was adjusted to 25° C. and a nitrogen sparge was started at the rate of 100 ml of nitrogen per minute per Kg of total charge. After nitrogen had been passed for 15 minutes, there were added in the order stated the following initiator charges, prepared immediately prior to addition by dissolving each solid in water:

Ammonium persulphate: 0.18 part
Distilled Water: 9 parts
Sodium dithionite: 0.3 part
Distilled water: 9 parts The nitrogen flow rate was then reduced to 20 ml per minute per Kg. of total charge, and the temperature was maintained within the range 25°–30° C. for a total period of 7 hours counted from the addition of the initiators, cooling as necessary in order to control the reaction exotherm. Finally there was added 18 parts of a 0.1% solution of n-octyl mercaptan and stirring and nitrogen flow were then discontinued. There was thus obtained an aqueous microgel copolymer emulsion of approximately 20% by weight solids content and average particle size 0.08 micron. The relative viscosity of the copolymer was 2.06 and the differential orifice flow rate 4.60 ccs/30 secs, both measured on AVTUR 50 containing 0.3% by weight of the copolymer. When subjected to the trolley ignition test hereinabove described, AVTUR 50 containing the copolymer at 0.1% concentration did not give rise to any flare.

EXAMPLE 2

The procedure of Example 1 was repeated, except that the tert-butylstyrene used contained 25 ppm of added divinylbenzene instead of 5 ppm.

The product obtained was an aqueous copolymer emulsion of approximately 20% by weight solids content and average particle size 0.08 micron. The relative viscosity of the copolymer was 2.06 and the differential orifice flow rate 5.20 ccs/30 secs, in both cases measured on AVTUR 50 containing 0.3% by weight of the copolymer. When subjected to the trolley ignition test, AVTUR 50 containing the copolymer at 0.1% concentration did not produce any flare.

EXAMPLE 3

To a polymerisation vessel fitted with a nitrogen inlet extending below the liquid level there was charged the following:

Distilled water: 1152 parts
Acetone: 288 parts
Sodium dioctylsulphosuccinate: 9 parts This charge was stirred until the surfactant had completely dissolved. The agitator speed was set at 300±10 RPM and the following pre-mixed charge of monomer was added:

Tert-butylstyrene containing 15 ppm added divinylbenzene: 298.8 parts
Methyl methacrylate: 36.0 parts
Methacrylic acid: 25.2 parts The temperature of the reaction mixture was adjusted to 25° C. and the emulsion stirred for 5 minutes. A nitrogen purge was then started at 200 ml/minute. After 10 minutes of nitrogen purging the agitation speed was reduced to 120 RPM. After nitrogen had been passed for another 5 minutes, there were added in the order stated the following initiator charges, prepared immediately prior to addition by dissolving each solid in water:

Ammonium persulphate: 0.18 parts
Distilled water: 9 parts
Sodium dithionite: 0.275 parts
Distilled water: 9 parts The nitrogen flow rate was then reduced to 40 ml/minute and the temperature was maintained within the range 25°–30° C. for a total period of 6 hours counted from the addition of the initiators, cooling as necessary in order to control the reaction exotherm. Finally there was added 18 parts of a 0.1% solution of n-octyl mercaptan. Stirring and nitrogen flow were discontinued 5 minutes after addition of the mercaptan. The product obtained was an aqueous copolymer emulsion of approximately 20% by weight solids content. The differential orifice flow rate as measured on Jet A fuel containing 0.3% by weight of the copolymer was 4.7 ccs./30 secs.

EXAMPLE 4

The procedure of Example 3 was repeated, except that the tert-butylstyrene used contained 15 ppm added ethylene glycol dimethacrylate in place of the added divinylbenzene.

The product obtained was an aqueous copolymer emulsion of approximately 20% by weight solids content. The differential orifice flow rate as measured on Jet A fuel containing 0.3% by weight of the copolymer was 4.5 ccs./30 secs.

EXAMPLE 5

The procedure of Example 3 was repeated, except that the tert-butylstyrene used contained 50 ppm added ethylene glycol dimethacrylate in place of the added divinylbenzene.

The product obtained was an aqueous copolymer emulsion of approximately 20% by weight solids content. The differential orifice flow rate as measured on Jet A fuel containing 0.3% by weight of the copolymer was 4.2 ccs./30 seconds.

EXAMPLE 6

The procedure of Example 3 was repeated except that the nitrogen flow rate was maintained at 200 ml/min throughout the reaction and the tert-butylstyrene used contained 25 ppm added isopropenylstyrene in place of the added divinylbenzene.

The product obtained was an aqueous copolymer emulsion of approximately 20% by weight solids content. The differential orifice flow rate as measured on Jet A fuel containing 0.3% by weight of the copolymer was 5.2 ccs./30 secs. The intrinsic viscosity of the copolymer in Jet A was 1.8 dl/g.

What I claim is:

1. A modified liquid hydrocarbon fuel having a flash point of at least 50° F. and having a reduced tendency to particulate dissemination under shock conditions, the fuel containing from 0.05% to 2% of its weight of particles of polymer microgel, the particles having, in the absence of the liquid fuel, a size in the range 0.02 to 0.5 microns and the said polymer being derived from a monomer mixture comprising:

(i) at least one monomer which carries hydroxyl, carboxyl or carboxylamide groups, in an amount of from 0.5% to 15% by weight of the total monomer mixture;

(ii) at least one crosslinking monomer which is multifunctional with respect to the polymerization reaction, in an amount of from 0.0001% to 1% by weight of the total monomer mixture; and (iii) at least one other monomer different from the monomers (i) and (ii), the total monomers constituting 100% by weight, provided that (a) monomers (i) and (iii) are so selected that a copolymer thereof, in the absence of monomer (ii), would be soluble in the liquid fuel at concentrations in the range 0.05% to 2% by weight as aforesaid, and (b) the degree of crosslinking of the polymer is such that the particles of polymer are swollen in the presence of the fuel to an extent such that they exhibit no tendency to settle so as to form a macroscopic separate phase.

2. A hydrocarbon fuel as claimed in claim 1, wherein the main monomer (i) is selected from alkyl acrylates and methacrylates in which the alkyl group contains from 4 to 18 carbon atoms, alkyl styrenes in which the alkyl group contains from 4 to 12 carbon atoms and vinyl esters of fatty acids.

3. A hydrocarbon fuel as claimed in claim 2, wherein the multifunctional monomer is selected from isopropenylstyrene, divinylbenzene, ethylene glycol dimethacrylate and allyl methacrylate.

4. A hydrocarbon fuel as claimed in claim 1, wherein the multifunctional monomer constitutes from 0.0005% to 0.1% by weight of the total monomer.

5. A hydrocarbon fuel as claimed in claim 1, monomer (i) is selected from hydroxyalkyl acrylates, hydroxyalkyl methacrylates, acrylic acidd, methacrylic acid and their metal or amine salts, acrylamide and methacrylamide.

6. A hydrocarbon fuel containing from 0.05% to 2% of its weight of particles of polymer microgel derived from a mixture of tert-butylstyrene, methyl methacrylate and methacrylic acid in the weight ratios 83:10:7 containing from 0.001% to 0.0025% by weight of divinylbenzene.

7. A hydrocarbon fuel containing from 0.05% to 2% of its weight of particles of polymer microgel derived from a mixture of tert-butylstyrene, methyl methacrylate and methacrylic acid in the weight ratios 83:10:7 containing from 0.001% to 0.004% of ethylene glycol dimethacrylate.

8. A hydrocarbon fuel containing from 0.05% to 2% of its weight of particles of polymer microgel derived from a mixture of tert-butylstyrene, methyl methacrylate and methacrylic acid in the weight ratios 83:10:7 containing 0.002% of isopropenylstyrene.

9. A hydrocarbon fuel as claimed in any one of claims 6 to 12, wherein the microgel polymer has been made in aqueous dispersion by aqueous emulsion copolymerisation of the monomers.

10. A hydrocarbon fuel as claimed in any one of claims 6 to 13, into which the microgel particles have been introduced in the form of an aqueous dispersion under conditions such that the water is removed as an azeotrope with some of the hydrocarbon.

11. A hydrocarbon fuel as claimed in any one of claims 6 to 12, into which the microgel particles have been introduced in the form of a blend with a carrier fluid which is essentially a non-swellant for the particles but is miscible with the liquid fuel.

* * * * *